US010123585B2

(12) United States Patent
Price et al.

(10) Patent No.: US 10,123,585 B2
(45) Date of Patent: Nov. 13, 2018

(54) SOLE FOR A SHOE

(71) Applicant: adidas AG, Herzogenaurach (DE)

(72) Inventors: Daniel Stephen Price, Herzogenaurach (DE); Angus Wardlaw, Nürnberg (DE); Christopher Edward Holmes, Vietsbronn (DE); Falk Bruns, Nürnberg (DE); Robert Leimer, Portland, OR (US); John Whiteman, Nürnberg (DE); Timothy Kelvin Robinson, San Francisco, CA (US); Heiko Schlarb, Neustadt a.d. Aisch (DE); Warren Freeman, Guangzhou (CN)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/269,454

(22) Filed: May 5, 2014

(65) Prior Publication Data

US 2014/0325871 A1 Nov. 6, 2014

(30) Foreign Application Priority Data

May 3, 2013 (DE) ..... 10 2013 208 170

(51) Int. Cl.
*A43B 13/00* (2006.01)
*A43B 13/18* (2006.01)
(Continued)

(52) U.S. Cl.
CPC ..... *A43B 13/18* (2013.01); *A43B 13/125* (2013.01); *A43B 13/14* (2013.01); *A43B 13/184* (2013.01); *A43B 13/26* (2013.01)

(58) Field of Classification Search
CPC ..... A43B 13/18; A43B 13/14; A43B 13/26; A43B 13/125; A43B 13/184; A43B 13/22; A43B 13/223; A43B 13/24
(Continued)

(56) References Cited

U.S. PATENT DOCUMENTS 429,429 A * 6/1890 Echhardt ..... A43B 7/06 152/210
997,657 A * 7/1911 Drake ..... A43B 5/06 36/129

(Continued)

FOREIGN PATENT DOCUMENTS

CN 100508809 7/2009
DE 102006025990 12/2006

(Continued)

OTHER PUBLICATIONS

Chinese Application No. 201410184578.7, Office Action dated Jul. 3, 2015, 7 pages (No English translation available. A summary of the Office Action is provided in the Transmittal Letter submitted herewith).

(Continued)

*Primary Examiner* — Katharine Gracz
(74) *Attorney, Agent, or Firm* — Kilpatrick Townsend & Stockton LLP

(57) ABSTRACT

Soles for a shoe have a midsole with a base body and a plurality of deformation elements, and an outsole with a first outsole region and a plurality of first outsole elements. Pressure load on one first outsole element of the plurality of first outsole elements leads to a deformation of at least one of the plurality of deformation elements which are associated with the one first outsole element of the plurality of first outsole elements.

8 Claims, 14 Drawing Sheets

(51) Int. Cl.
*A43B 13/12* (2006.01)
*A43B 13/14* (2006.01)
*A43B 13/26* (2006.01)

(58) Field of Classification Search
USPC ..... 36/29, 25 R, 31
See application file for complete search history.

(56) References Cited

U.S. PATENT DOCUMENTS 4,085,527 A 4/1978 Riggs
4,271,606 A * 6/1981 Rudy ..... A43B 13/223 36/29
4,747,220 A * 5/1988 Autry ..... A43B 13/26 36/114
4,897,936 A * 2/1990 Fuerst ..... A43B 13/12 36/114
5,367,791 A * 11/1994 Gross ..... A43B 13/26 36/25 R
5,647,145 A * 7/1997 Russell ..... A43B 3/0052 36/25 R
5,775,005 A * 7/1998 McClelland ..... A43B 1/0072 36/134
6,065,230 A * 5/2000 James ..... A43B 3/0057 36/25 R
6,082,024 A * 7/2000 Del Biondi ..... A43B 7/14 36/28
6,145,221 A 11/2000 Hockerson
D468,079 S * 1/2003 DeGrand ..... D2/947
6,748,675 B2 * 6/2004 Sato ..... A43B 13/223 36/28
6,880,267 B2 * 4/2005 Smaldone ..... A43B 1/0072 36/28
6,915,596 B2 * 7/2005 Grove ..... A43B 13/223 36/100
6,968,636 B2 11/2005 Aveni et al.
7,036,245 B2 * 5/2006 Russell ..... A43B 7/1415 36/29
7,168,187 B2 * 1/2007 Robbins ..... A43B 3/0078 36/14
7,200,955 B2 * 4/2007 Foxen ..... A43B 7/1425 36/25 R
7,277,021 B2 * 10/2007 Beebe ..... A43B 3/0005 340/517
D571,089 S * 6/2008 Centurione ..... D2/956
7,523,566 B2 * 4/2009 Young-Chul ..... A43B 13/12 36/28
D597,735 S * 8/2009 Norton ..... D2/957
D616,640 S * 6/2010 Werman ..... D2/951
D619,345 S * 7/2010 Favreau ..... D2/951
7,748,141 B2 * 7/2010 Smith ..... A43B 13/16 36/28
7,757,410 B2 7/2010 Aveni et al.
7,793,428 B2 * 9/2010 Shenone ..... A43B 1/0072 36/25 R
7,797,856 B2 * 9/2010 Andrews ..... A43B 13/12 36/25 R
D625,092 S * 10/2010 Moon ..... D2/951
7,954,257 B2 * 6/2011 Banik ..... A43B 7/144 36/28
7,966,748 B2 * 6/2011 Votolato ..... A43C 15/02 36/100
8,220,182 B2 * 7/2012 Righetto ..... A43B 7/144 36/141
D664,748 S * 8/2012 Lubart ..... D2/923
8,256,145 B2 * 9/2012 Baucom ..... A43B 1/0018 36/61
D677,454 S * 3/2013 Pizzuti ..... D2/951
8,474,155 B2 * 7/2013 McDonald ..... A43B 1/0063 36/102
8,584,380 B2 * 11/2013 Auger ..... A43C 15/168 36/134
8,616,892 B2 * 12/2013 Morag ..... A43B 5/02 434/251
8,656,610 B2 * 2/2014 Baucom ..... A41D 13/065 36/61
8,656,611 B2 * 2/2014 Baucom ..... A43B 1/0018 36/61
8,677,655 B2 * 3/2014 Chen ..... A43B 3/0047 36/59 C
8,763,277 B2 * 7/2014 Sartor ..... A43B 7/1415 36/25 R
D713,629 S * 9/2014 Petrie ..... D2/951
D723,777 S * 3/2015 Cin ..... D2/951
D727,610 S * 4/2015 Francis ..... D2/951
9,044,067 B2 * 6/2015 Edington ..... A43B 7/144
D765,962 S * 9/2016 Brilliant ..... D2/951
2003/0208929 A1 11/2003 Lucas et al.
2005/0005474 A1 * 1/2005 Lai ..... A43B 5/02 36/30 R
2005/0268490 A1 12/2005 Foxen
2005/0283999 A1 * 12/2005 Whatley ..... A43B 13/20 36/29
2008/0072462 A1 3/2008 Fusco
2008/0167741 A1 * 7/2008 Lay ..... A43B 3/00 700/94
2010/0293816 A1 * 11/2010 Truelsen ..... A43B 5/06 36/30 R
2011/0126422 A1 * 6/2011 Vattes ..... A43B 7/144 36/10
2011/0192056 A1 8/2011 Geser et al.
2011/0260857 A1 * 10/2011 Hamill ..... A43B 17/00 340/539.13
2011/0277346 A1 11/2011 Peyton et al.
2012/0144695 A1 6/2012 McDowell et al.
2013/0213145 A1 * 8/2013 Owings ..... A43B 3/0005 73/862.046
2013/0263469 A1 * 10/2013 Braunschweiler ... A43B 13/184 36/28

FOREIGN PATENT DOCUMENTS

DE 202012010879 1/2013
WO 9808405 3/1998
WO 03071893 9/2003
WO 2005066250 7/2005

OTHER PUBLICATIONS

European Patent Application No. 14165917.7, European Search Report, dated Sep. 30, 2014, 5 pages.
German Patent Application No. 102013208170.7, Office Action dated Jul. 27, 2017, 14 pages (7 pages English translation and 7 pages of original document).

* cited by examiner

SOLE FOR A SHOE

CROSS REFERENCE TO RELATED APPLICATION

This application is related to and claims priority benefits from German Patent Application No. DE 10 2013 208 170.7, filed on May 3, 2013, entitled SOLE FOR A SHOE ("the '170 application"). The '170 application is hereby incorporated herein in its entirety by this reference.

FIELD OF THE INVENTION

The present invention relates to a sole for a shoe, in particular a sole for a sports shoe.

BACKGROUND

With the aid of shoe soles, shoes are provided with a wealth of different characteristics that may be pronounced in various strengths depending on the specific type of shoe. Primarily, the shoe soles have a protective function. They protect the foot of the respective wearer by way of their increased stiffness in comparison with the shoe shaft from injuries through e.g. sharp objects on which the shoe wearer treads. Furthermore, the outsole typically protects the midsole of the shoe from excessive wear by an increased abrasion resistance. It can also be a function of a shoe sole to provide a certain stability. Additionally, a shoe sole can provide a cushioning effect, for example to cushion or absorb the forces occurring during contact of the shoe with the ground. Furthermore, a shoe sole can protect the foot from dirt or spray water.

In order to meet this wealth of functionalities, different materials are known from the prior art from which shoe soles or individual parts of such soles may be made. As examples, shoe soles or parts of shoe soles made from ethylene-vinyl-acetate (EVA), thermoplastic polyurethane (TPU), particle foam out of expanded thermoplastic urethane (eTPU) or expanded polypropylene (ePP), rubber, polypropylene (PP) or polystyrene shall be mentioned here. Each of these different materials provides a specific combination of different properties which are, depending on the respective requirement profiles, more or less well suited for the soles of particular shoe types.

Therefore, the use of expanded materials, in particular the use of particle foam from expanded thermoplastic urethane (eTPU), has been considered for the construction of shoe soles, for example in WO 2005/066250 A1.

A further function of shoe soles may be to increase the adhesion or grip of a shoe on the respective ground in order to facilitate a faster movement and to minimize the risk of a fall of the wearer. To this end, the outsole of a shoe can, for example, be provided with a profile and the shoe can have a number of knobs, cleats, spikes and the like.

For example, U.S. Pat. No. 4,085,527 describes an athletic shoe having a sole which includes a cushioning pad and a plurality of cleats extending from the lower surface of the sole and being particularly configured in the heel region to provide stability and effective cushioning during running. However, a disadvantage of this construction is, in particular, that the cushioning pad extends in a planar and roughly evenly thick manner throughout the entire sole and therefore influences the properties of the sole across the entire sole area in the same manner, without a possibility to selectively control the cushioning- and stability characteristics. This can, in particular, result in the sole not having the desired stability in the midfoot area.

A sole construction is furthermore known from WO 03/071893 A1, which comprises in some embodiments a spring member that includes at least one primary stud and one or more secondary studs, which operate to engage with the ground when an impact force causes the primary stud to deform towards the sole. In this way, additional grip may be provided on varying surface conditions. This construction is, however, technically very complex and is mainly suited for shoes with cleats and/or knobs, e.g. football shoes.

Other sole constructions, in particular for shoes with cleats or knobs, are described in U.S. Pat. No. 6,145,221, as well as in WO 98/08405 A1.

A general disadvantage of the shoe soles known from the prior art is that they are typically intended for a specific type of use only, or are tuned to particular surfaces/ground conditions. Thus, for example, shoes with cleats are particularly well suited for use on soft ground, for example a grass pitch, whereas shoes with spikes can mainly be used on a tartan track, a golf course, or the like. Both types of shoes are, however, not well suited for running on hard ground, as for example asphalt. Other shoes, as for example indoor soccer shoes or basketball shoes, typically have a sole with only a mild profile in order to ensure as large a contact area with the indoor surface as possible. Such shoes do not, however, provide sufficient grip on, for example, (wet) grass or moist forest soil. Especially in the area of running sports, in particular during jogging or fitness runs, a wearer is often confronted with different ground- and surface conditions. For example, a runner can initially cover a part of a run on a pavement or a street and then change to a soft forest trail.

Starting from prior art, it is therefore the underlying problem of the present invention to provide a shoe sole which is capable of adapting to such varying conditions and in particular to provide as good a grip on different grounds as possible. At the same time, the manufacturing expenses shall be as small as possible.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a sole for a shoe comprises a midsole comprising a base body and a plurality of deformation elements, and an outsole comprising a first outsole region and a plurality of first outsole elements, wherein a pressure load on one first outsole element of the plurality of first outsole elements leads to a deformation of at least one of the plurality of deformation elements which are associated with the one first outsole element of the plurality of first outsole elements.

In certain embodiments, the plurality of first outsole elements are integrally formed with the first outsole region and/or may be formed in a downward protruding manner.

The base body may comprise a plurality of notches in which the plurality of deformation elements are arranged. In certain embodiments, in every notch there is arranged one deformation element of the plurality of deformation elements.

In some embodiments, the midsole further comprises a connecting layer by which multiple deformation elements of the plurality of deformation elements are connected to each other. The multiple deformation elements and the connecting layer may be provided as a single integral piece.

According to certain embodiments, a material of the base body has a greater stiffness than a material of the plurality of deformation elements. In some embodiments, a midsole further comprises at least one cushioning insert in at least one of a forefoot region and a heel region.

In certain embodiments, for at least for a subset of the plurality of first outsole elements, each first outsole element of the subset has exactly one associated deformation element of the plurality of deformation elements.

Each of the plurality of first outsole elements may have an associated flexible region of the outsole, which facilitates movement of each of the plurality of first outsole elements relative to the first outsole region. The flexible regions may surround each of the plurality of first outsole elements.

According to certain embodiments, a protective element comprises notches in a region of the plurality of first outsole elements is arranged between the outsole and the midsole.

At least one of the first outsole region and the plurality of first outsole elements are formed at least partially transparent.

In some embodiments, the sole further comprises at least one reinforcing element in at least one of a central, lateral, and medial midfoot regions. The sole may also further comprise a cavity for receiving an electronic component. In certain embodiments, a shoe may comprise the sole described above.

According to certain embodiments of the present invention, a sole for a shoe comprises a midsole comprising a base body and a plurality of deformation elements, and an outsole comprising a first outsole region and a plurality of first outsole elements, and a second outsole region comprising no first outsole elements, wherein a pressure load on one first outsole element of the plurality of first outsole elements leads to a deformation of at least one of the plurality of deformation elements which are associated with the one first outsole element of the plurality of first outsole elements.

In these embodiments, the second outsole region is arranged in at least one of a toe region, a midfoot region, and a heel region. The second outsole region may also comprise profile elements and be arranged at a rim of the sole.

BRIEF DESCRIPTION OF THE DRAWINGS

In the following detailed description, various embodiments of the present invention are described with reference to the following figures.

BRIEF DESCRIPTION

Figure 1A:
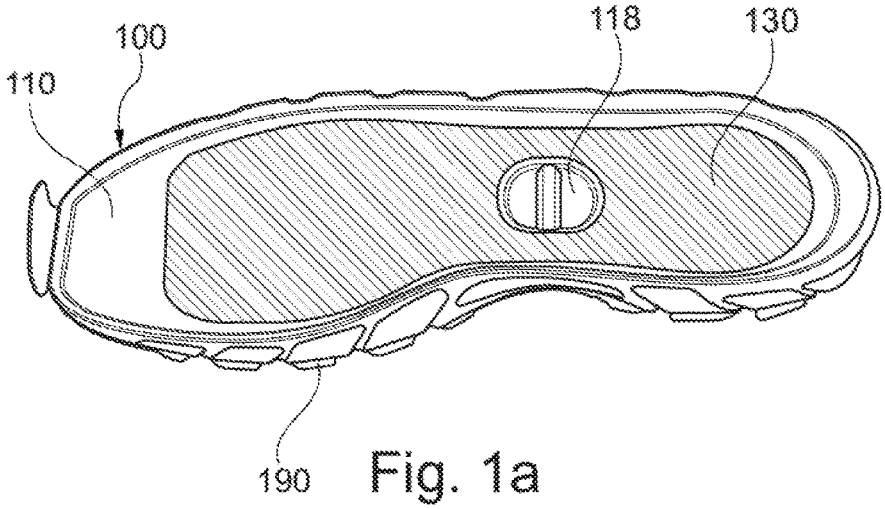
FIGS. 1*a-i* are perspective views of a sole, according to certain embodiments of the present invention.

According to certain embodiments of the present invention, a sole for a shoe, in particular a sports shoe, comprises a midsole and an outsole. The midsole comprises a base body and a plurality of deformation elements. The outsole comprises a first outsole region and a plurality of first outsole elements, wherein a pressure load on a first outsole element leads to a deformation of at least one of the deformation elements which are associated with the first outsole element.

In some embodiments, the first outsole elements are integrally formed with the first outsole region.

Furthermore, the first outsole elements may be arranged in a downward protruding manner.

Through an appropriate choice of the deformation stiffness of the deformation elements, the contact area and therefore the grip on different surfaces may be influenced and optimized with the inventive sole: on hard ground, as for example asphalt or pavements, the first outsole elements are pressed into the material of the deformation elements in such a manner that an enlarged contact area and therefore a better grip of the shoe is created. On softer ground, by contrast, as for example soft grass or forest soil, the pressure load on the first outsole elements is smaller, such that they penetrate into the material of the deformation elements to a smaller amount. Particularly if the first outsole elements are arranged in a downward protruding manner, i.e. extending from the face of the outsole that is facing towards the floor in the direction of the floor, they thus function as a kind of "cleats" and facilitate improved grip also in this instance.

A further benefit of the inventive shoe sole is the fact that the outsole elements can adapt to the ground independent of one another. For example, only one outsole element may be pressed into the corresponding deformation element by a stone and therefore compensate minor unevenness.

In addition, an inventive sole may be made from a relatively small number of sole parts. As the first outsole elements and the first outsole region may be integrally formed, no dirt or water can get into the inner part of the shoe through these areas of the outsole.

For example, the base body may be integrally formed. However, a base body comprising a plurality of parts is also conceivable.

Within the scope of this document, "plurality" is to be understood to mean "two or more". For example, a plurality of deformation elements respectively comprises at least two deformation elements in the forefoot region and in the hindfoot region, or 9 deformation elements in the forefoot region and 4 deformation elements in the hindfoot region, or also 10 deformation elements in the forefoot region and 4 deformation elements in the hindfoot region.

By a pressure load, mainly a load on the first outsole elements that acts away from the ground in the direction of the foot/sole shall be understood. However, also included are shearing forces acting aslant, i.e. loads and forces that comprise both a vertical component (in the direction from the ground towards the foot) and a horizontal component (lying in one plane with the ground), as well as forces/loads acting only horizontally. Such forces/loads can also cause a deformation of the deformation elements as described above.

In certain embodiments, the base body comprises a plurality of notches in which the deformation elements are arranged. In some embodiments, in each notch there is arranged one deformation element.

In so doing, further influence may be exerted, through the shape and size of the notches, on the deformation behavior of the deformation elements and in this way the behavior of the sole on different grounds may be influenced. In particular, if in each notch there is arranged exactly one deformation element, this influence may be exerted locally and independently from each other in different parts of the sole.

In some embodiments, the deformation elements are essentially cylindrically formed. A cylindrical shape simplifies the manufacture, for instance since cylindrical tools are often easy to use, and furthermore minimizes the share of material of the sole which is taken up by the deformation elements. This can, for example, be relevant if a sole is desired to have a large basic stability, for example for mountain runs or cross-country runs, wherein a runner often treads down unevenly, and still ensure as good an adaption to different ground conditions as possible.

In some embodiments, the midsole further comprises a connecting layer, by which multiple deformation elements are connected to each other. In some embodiments, all deformation elements are connected to each other by the connecting layer. Herein, the deformation elements and the connecting layer may be provided as a single integral piece. This, too, simplifies the manufacture of such a sole according to the invention. In addition, the connecting layer can assume further functional purposes within the sole, for example as a cushioning element, e.g. if it is formed of soft foam, or a reinforcing element, if it is made of hard foam or formed as a plate.

In the assembled state of the sole, the connecting layer may be arranged on the side of the base body that is facing the foot. This may be beneficial, in particular, in the case when the connecting layer assumes, as described above, a further function, in particular the function of a cushioning layer or an insole layer.

In some embodiments, the material of the base body has a greater stiffness than the material of the deformation elements. Optionally, the material of the base body also has a greater stiffness than the material of the connecting layer. Thereby, the base body can provide the sole with the desired stability, whereas the material of the deformation elements can essentially be chosen without a loss of stability in such a manner that the desired adaptivity of the sole to different grounds may be ensured.

In some embodiments, the entire midsole is provided as a single integral piece, for example via multi-component injection molding. This additionally increases the durability and resilience of the sole and simplifies the manufacture, since no assembly of the sole is required. A further advantage in this is that no stiff transitions result at the edges/walls of the different materials.

In some embodiments, the base body, the deformation regions and the connecting layer, or one or more of the aforementioned parts of a sole according to the invention, comprise one or more of the following materials: polyurethane, ethylene-vinyl-acetate, thermoplastic urethane, particle foam particularly made out of expanded thermoplastic urethane (eTPU) or expanded polypropylene (ePP). These materials have particularly favorable properties for the constructions of shoe soles, in particular midsoles, which may be employed depending on the respective requirement profile of the sole.

Furthermore, in certain embodiments, the midsole comprises at least one cushioning insert in the forefoot region and/or the (rear) heel region. This, for instance, could conceivably be an additional deformation element which is arranged on top of the connecting layer. This can, for example, comprise a highly viscous compound. Such a cushioning insert further increases the possibilities to influence the properties of the sole, in particular the cushioning properties during treading down with the heel or pushing the foot off the ground. It is also to be noted here that the deformation elements are primarily provided for the adaptation to the ground and not so much for the cushioning of a shoe that is equipped with a sole according to the invention. Hence, potential cushioning inserts arranged on top in the most important areas (e.g. at the heel and the forefoot) may be desirable.

In some embodiments, at least for a subset of the first outsole elements, each outsole element of the subset has exactly one associated deformation element. In some embodiments, all of the first outsole elements have exactly one associated deformation element. Thereby, the behavior of each outsole element during treading down on different grounds can individually be influenced and controlled, so that unevenness may be particularly well compensated, for example. Furthermore, one can tune the behavior of the sole according to the invention upon treading down particularly well to the individual running style of a runner and/or to the weight of the runner.

However, it is also conceivable that several first outsole elements are associated with one common deformation element.

Furthermore, an arrangement is also generally possible in which one or more first outsole elements are respectively associated with several deformation elements each, e.g. two deformation elements separated by a bar respectively.

In some embodiments, the first outsole elements each have an associated flexible region of the outsole which facilitates movement of the first outsole elements relative to the first outsole region. This allows manufacturing the first outsole region in such a way, in particular sufficiently thick and firm, that it provides the desired stability and protective function, without unduly constraining movement of the first outsole elements and with that the adaptivity of the shoe sole.

In certain embodiments, the flexible regions have a lower thickness of the outsole material than the first outsole region. Such a construction allows for a particularly easy manufacture and still provides the above mentioned benefits.

Here, the flexible regions, which can for instance be formed as a kind of material weakness as described above or as a kind of "hinge", may surround the first outsole elements. This allows e.g. the weakening of the outsole regions in the direct vicinity of the first outsole elements, without affecting the properties of the first outsole region in other areas.

In some embodiments, the first outsole region has a grid-shaped form. A honeycomb shape or similar is also conceivable. This permits for instance material savings and thus weight reduction and can furthermore provide a look in the inner workings of the sole according to the invention, in particular a look at the midsole.

In some embodiments, the outsole further comprises a second outsole region that comprises no first outsole elements. Such a second outsole region may, for example, be employed in regions of the sole where an adaption of the sole to varying ground conditions is not necessary or not wanted. The second outsole region may have further influence on the stability of the sole, or act as decoration, for example by way of striking colors.

Possible is an arrangement of the second outsole region in the toe region, the midfoot region and/or the heel region, particularly in the rear heel region, i.e. in the region behind the heel bone. Alternatively or in addition, the second outsole region may be arranged at the rim of the sole.

In some embodiments, the second outsole region further comprises profile elements, e.g. downward protruding profile elements. Hereby, the second outsole region may, for example, serve as further profiling of the sole.

In certain embodiments, a protective element is arranged between the outsole and the midsole. In some embodiments, this protective element comprises notches or openings in the region of the first outsole elements. For example, such a protective element may be a fabric-like element or a foil-like element, and it can protect the midsole from external influences, such as abrasion, moisture, etc. By corresponding notches in the region of the first outsole elements, a disadvantageous influence of the adaptability of the sole according to the invention may be largely avoided.

In some embodiments, no first outsole elements and/or deformation elements are located in the region of the arch of the foot. A high stability of the shoe sole in the region of the arch of the foot is desirable, particularly in running sports, in order to achieve support for the arch of the foot and thus to permit dynamic running as well as conveying a good feeling of stability.

In some embodiments, the first outsole region and/or the first outsole elements are formed at least partially transparent. This allows for a look into the workings of the sole and facilitates, for example, recognition of damaged regions of the sole from the outside. In conjunction with a cavity for receiving an electronic component, as further described in the following, this can further facilitate access to such a component. For example, the different components of the sole according to the invention may be differently colored so that the different parts may be particularly well distinguished and identified from the outside.

In connection with a cavity for an electronic component, as described further in the following, this can also facilitate the access to such a component.

In some embodiments, the outsole comprises one or more of the following materials: rubber, thermoplastic urethane, particle foam out of expanded thermoplastic polyurethane or expanded polypropylene. These materials have favorable properties for the construction of shoe soles, in particular of outsoles, which may be desirable depending on the respective requirements of the sole.

In some embodiments, the sole further comprises at least one reinforcing element in the central, lateral and/or medial midfoot region. Conceivable examples for such a reinforcing element are, for instance, a centrally arranged torsion support, or a medially arranged pro-moderator, which restricts the pronation. Also, several of such reinforcing elements may be combined with one another. As already mentioned, in particular for running shoes, an increased stability in the midfoot region is desirable in order to protect the runner from injuries or overstraining of the arch of the foot and to provide him with a feeling of security also during fast running.

In some embodiments, the sole furthermore comprises a cavity for receiving an electronic component. Such a component can, for example, be a sensor, an acceleration sensor or a gyroscope for instance, which records, saves and sends/transmits data of the wearer of the shoe during running. In particular, a GPS receiver is conceivable, which determines the position of the runner, or the like. In some embodiments, access to the electronic component may be gained from inside the shoe: The cavity for the electronic component is arranged underneath the insole/inner sole by which the component is protected from dirt and water. In the event of an at least partially transparent sole, the sensor could nevertheless be visible from the outside.

In further embodiments of the invention, the plurality of deformation elements are formed out of the base body as a result of the fact that a reinforcement layer is arrange on the side of the base body that faces away from the foot, which has a respective opening in each of the regions of the base body acting as a deformation elements. In some embodiments, the reinforcement layer comprises a plate-like and/or a stretch-resistant foil-like element.

Through the reinforcement layer, the stability of the base body is increased in the regions adjacent to the reinforcement layer, while in the regions of the base body, in which the reinforcement layer has notches/openings, an individual deformation of the material of the base body can occur via the first outsole elements upon a pressure load. This construction thus permits the manufacture of a sole according to the invention, which provides the already described adaptability to different ground conditions by through the use of a relatively small number of sole parts. In particular, the midsole may be manufactured out of a single material.

Furthermore, the embodiments described here may also be combined with the other embodiments explained herein.

Further embodiments of the invention are provided by a shoe, in particular a sports shoe, comprising a sole according to the invention. Herein, individual features of the invention and of the shown embodiments can, depending on the specific requirements of the sole and the shoe, be combined with each other in desirable manner.

It is further made explicit reference to the fact that in doing so individual aspects of the invention and of the shown embodiments can also be left out, should these aspects be of no relevance and/or not desirable for the respective shoe, without the possibility to construe such a sole or such a shoe as not belonging to the present invention any more.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, certain embodiments of the invention are described in relation to sports shoes. It is emphasized, however, that the current invention is not restricted to these embodiments. Rather, the current invention can, for example, also be applied to working shoes, recreational shoes, trekking shoes and other kinds of shoes.

Figure 1B:
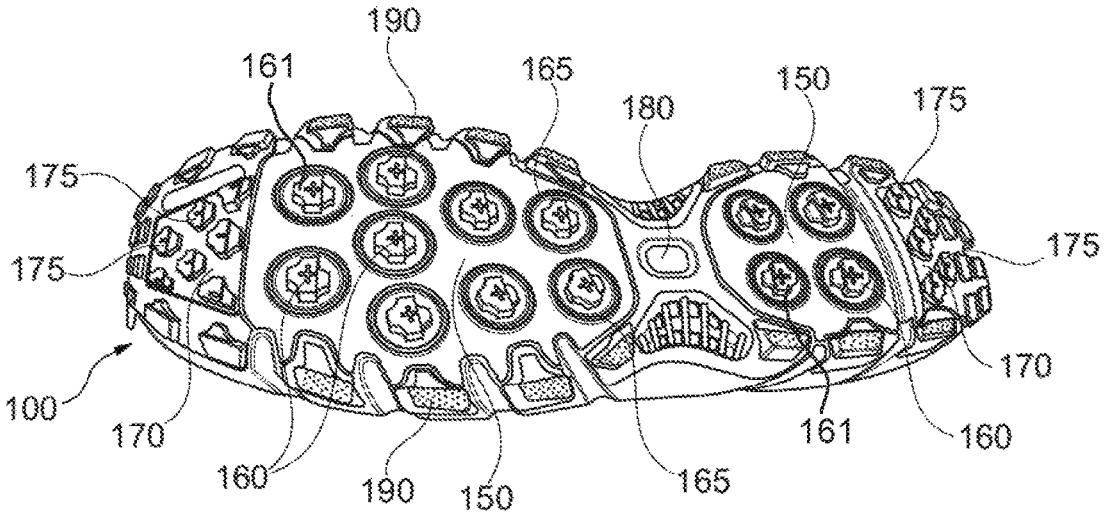
Figure 1C:
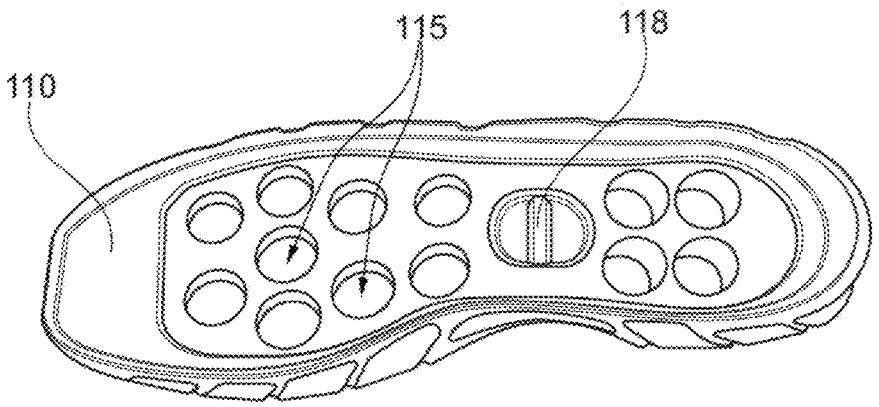
Figure 1D:
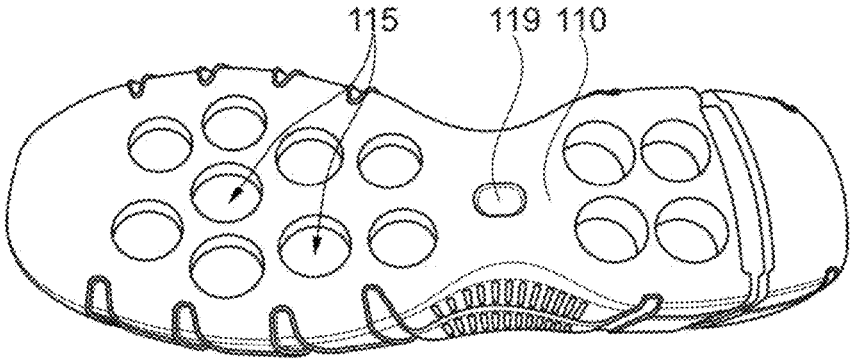
Figure 1E:
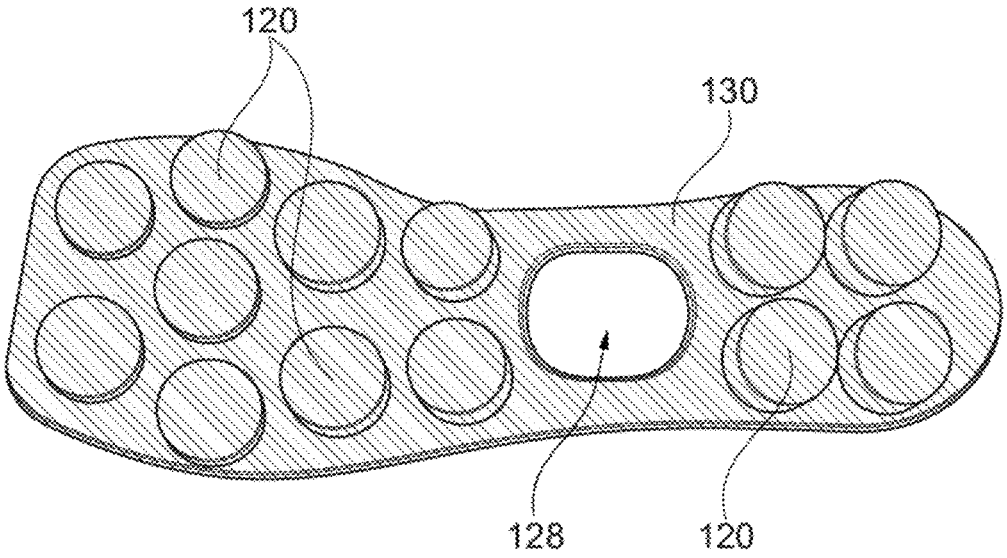
Figure 1F:
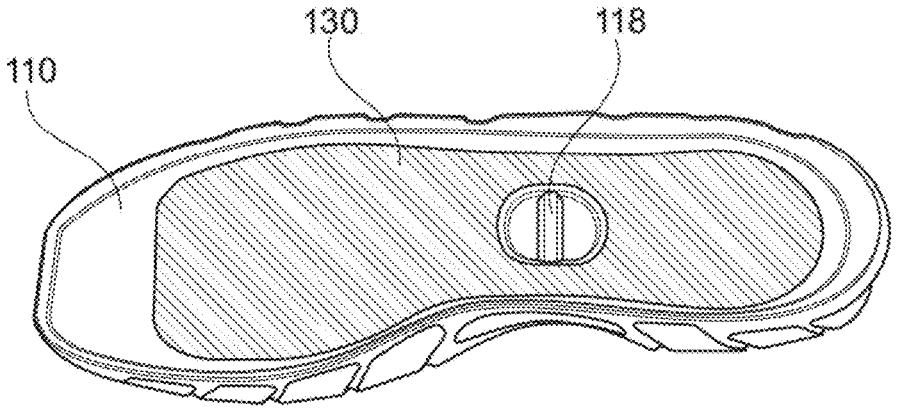
Figure 1G:
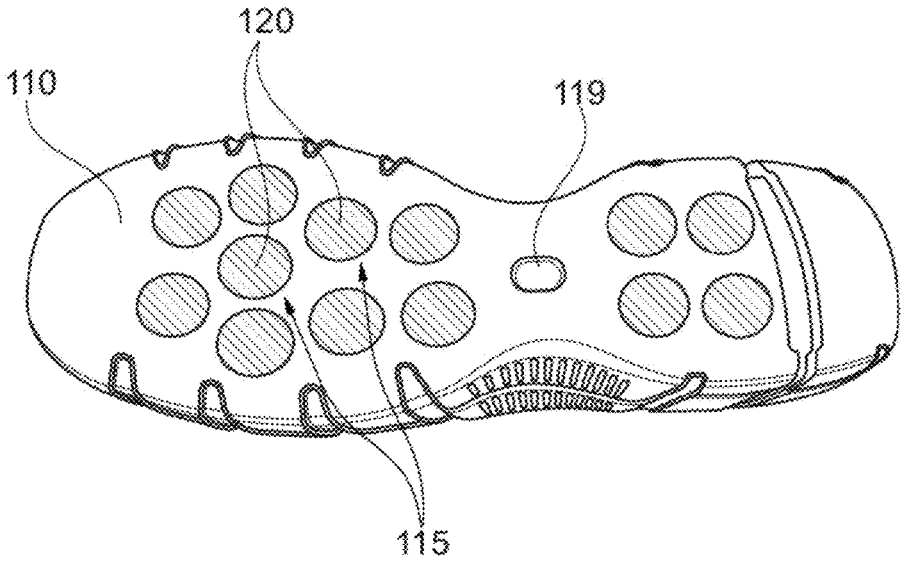
Figure 1H:
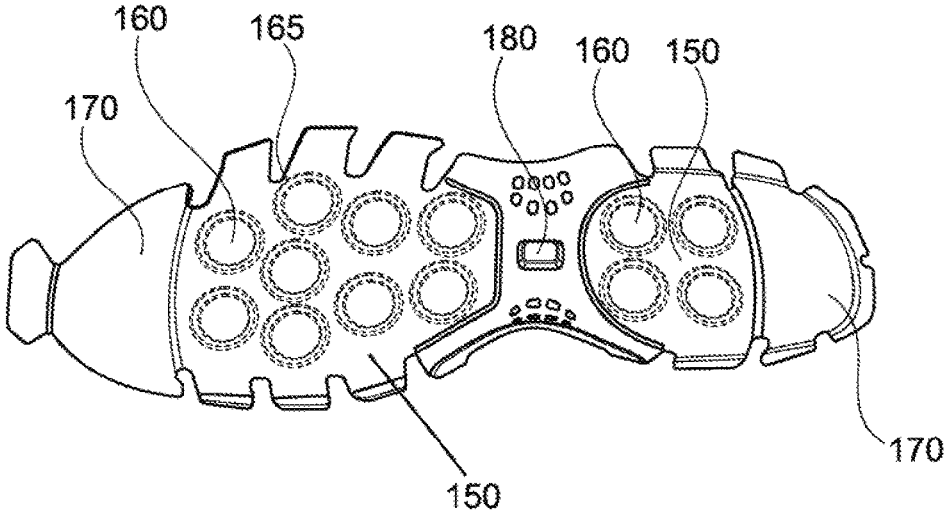
Figure 1I:
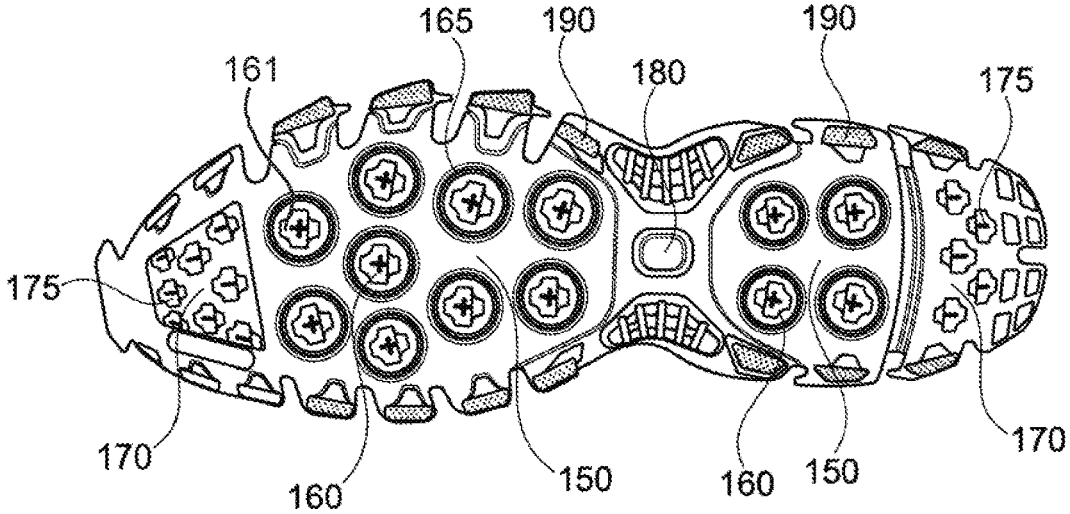

FIG. 1*a* shows the top side, i.e. the side facing towards the foot, and FIG. 1*b* the bottom side, i.e. the side facing away from the foot and facing the ground, of a sole 100 according to the invention in the assembled state. FIGS. 1*c-i*, by contrast, show embodiments of individual parts or partially assembled states of the sole 100.

First, the different regions of the sole 100, which will be discussed in greater detail in the following, are easily discernible: a toe region without deformation elements 120 and only with profile elements 175, a forefoot region with deformation elements 120, a midfoot region without deformation elements 120, but with a cavity 118 for an electronic component, a hindfoot region/heel region with deformation elements 120, as well as a rear hindfoot region/landing area situated behind the hindfoot region, without deformation elements 120, but with profile elements 175. Depending on the definition, the toe region may also be a part of the forefoot region, and the heel region may also be a part of the hindfoot region.

The sole 100 comprises a midsole, which comprises a base body 110 and a plurality of deformation elements 120.

In certain embodiments, the base body 110 in the embodiment 100 are integrally formed. In other embodiments, the base body 110 may be formed of multiple parts. Furthermore, within the scope of this document, at least two are to be regarded as a plurality. For example, a plurality of deformation elements 120 respectively comprise at least two deformation elements 120 in the forefoot region and in the hindfoot region, or 9 deformation elements in the forefoot region and 4 deformation elements in the hindfoot region, or 10 deformation elements in the forefoot region and 4 deformation elements in the hindfoot region, or any suitable combinations of deformation elements 120 in any suitable region.

The sole 100 further comprises an outsole, which comprises a first outsole region 150 and a plurality of first outsole elements 160, which may be formed downward protruding and may be integrally formed with the first outsole region 150. The outsole is arranged in such a way at the midsole that a pressure load on a first outsole element 160 leads to a deformation of one or more of the deformation elements 120 which are associated with the first outsole element 160. Thereby, the first outsole elements 160 are completely, to a certain extent, or only marginally pressed into the material of the deformation elements 120, depending on the quality of the ground, the deformation stiffness of the material of the deformation elements 120, and the forces acting while treading down (cf. also FIG. 6*a*).

By a pressure load, mainly a load of the first outsole elements 160 that acts away from the ground in the direction of the foot/sole 100 shall be understood. However, also included are shearing forces acting aslant, i.e. loads and forces that comprise both a vertical component (in the direction from the ground towards the foot) and a horizontal component (lying in one plane with the ground), as well as loads acting only horizontally. Such (shearing) loads and forces can also cause a deformation of the deformation elements 120 as described above.

In some embodiments, only one deformation element 120 is associated with each first outsole element 160. In other embodiments, several deformation elements 120 may be associated with one or several outsole elements, said deformation elements 120 being, for example, separated from each other by a bar of the base body 110, or the like.

If the first outsole elements 160 (or some of them) are completely pressed into the material of the deformation elements 120—for example when treading down on hard ground such as concrete or asphalt—such that the bottom sides of the first outsole elements 160 line up in one plane with the first outsole region 150 (cf. FIG. 6*a* and FIG. 7*a*), then the contact area of the sole 100 on the ground, and hence the grip of the sole 100, is increased.

On soft ground, by contrast, the first outsole elements 160 may be pressed only marginally into the material of the deformation elements 120, such that the first outsole elements 160 give the sole 100 a more pronounced profile and act as kinds of "cleats" or "knobs". This in turn leads to a better grip of the sole 100 on soft grounds. It is therefore evident for a skilled person that through an appropriate choice of the materials used for the manufacture of the sole 100, in particular the material of the deformation elements 120 and the first outsole elements 160, a sole 100 may be made which provides improved grip on varying grounds.

The grip of the sole 100 can furthermore be influenced by the shape of the first outsole elements 160. For example, inclusion of additional edges in the outsole elements 160 may improve the grip. In the embodiment 100 shown here, the first outsole elements 160 have a cross-like shape 161. Such a cross-like shape 161 allows a uniform grip/ground contact in all directions, both in linear sports, such as running, and in lateral sports/cutting. In other embodiments, the outsole elements 160 may have any suitable shape including but not limited to cylindrical, conical, semi-spherical, star-like, spike-like, tubular shapes, and the like.

In certain embodiments, the base body 110 comprises a plurality of notches 115 in which the deformation elements 120 are arranged. The deformation elements 120 may, as shown here, completely fill up the notches 115.

In other embodiments, the deformation elements 120 may only occupy a partial region of the notches 115. In such embodiments, the part of the notches 115 not occupied by the deformation elements 120 may, for example, remain vacant, or may be occupied by a material that differs from the material of the base body 110 and/or of the deformation elements 120.

Furthermore, in some embodiments, a single deformation element 120 may be arranged in each notch 115. This allows influencing the deformation properties of each deformation element 120 individually, for example, through a variation of the size of the individual notches 115 and deformation elements 120. For example, deformation elements 120 with a smaller diameter, whose deformation is restricted by the material of the base body surrounding them, typically possess a larger firmness/deformation stiffness than more extended deformation elements 120, whose deformation is not so much restricted by the surrounding material of the base body 110. Here, it may be noted that the material of the base body 110 may have a greater deformation stiffness than the material of the deformation elements 120. Smaller deformation elements 120 typically also lead to greater stability, whereas larger deformation elements 120 typically lead to lower stability, but the inverse may also be true in certain embodiments.

In other embodiments, however, multiple deformation elements 120 may be arranged in one notch 115, wherein potential existing interspaces between the individual deformation elements 120 within a notch 115 may either remain vacant, or may be filled up with a further material as described above. The shape of the notches 115 and the deformation elements 120 may also vary, whereby the deformation properties of the deformation elements 120 may be further influenced. The notches 115 and/or the deformation elements 120 may, for example, be essentially cylindrically formed. Essentially cylindrical notches 115 and/or deformation elements 120 may be, for example, expedient for a simple manufacture of such an inventive sole 100, since a cylindrical shape e.g. may be desirable for the manufacture and use of appropriate tools for the manufacture of soles 100 according to the invention. In other embodiments, any suitable shape may be used for the notches 115 and/or deformation elements 120 including but not limited to square, hemispherical, pyramid-shaped, and so forth.

Within the context of the present disclosure, the term "essentially" describes a property including deviations/tolerances caused by the manufacturing process.

In the embodiments shown here, the individual deformation elements 120 are furthermore connected to each other by a connecting layer 130, wherein the deformation elements 120 and the connecting layer 130 are integrally formed from the same material.

In other embodiments, only some of the deformation elements 120 may be connected by such a connecting layer 130. Furthermore, the deformation elements 120 and the connecting layer 130 need not be integrally formed and/or be made from the same material. For example, the deformation elements 120 and the connecting layer 130 may also be glued or melted together or be connected otherwise to each other.

Such a connecting layer 130 for one thing simplifies manufacture of an inventive sole 100, as, for example, all deformation elements 120 along with the connecting layer 130 may be inserted into a mold for further processing, with no need to position each deformation element 120 individually within such a mold. The deformation elements 120 together with the connecting layer 130 may also be injection-molded together in one mold, be die cut from a base form or be produced by particle foam. Furthermore, the connecting layer 130 can itself assume further expedient functions. In particular, if the connecting layer 130 is made from a deformable material, for example, the material of the deformation elements 120, the connecting layer 130 may also serve as a cushioning element or as an insole in order to attenuate the forces acting on the musculoskeletal system of the wearer during running, for example. To this end, the connecting layer 130, as shown here, may be arranged on the side of the base body 110 facing the foot. The midsole of the sole 100 may further comprise one or more additional cushioning inserts (not shown), for example made from a highly viscous elastomer compound, for example in the forefoot region and/or the heel region, to further improve the cushioning properties of the sole 100 and to further protect the wearer from injuries or symptoms of fatigue. In other embodiments, the cushioning element may be arranged on top of or below the connecting layer 130 or the base body 110, respectively.

Optionally, the base body 110 further comprises a cavity 118 for an electronic component in the region of the arch of the foot, which corresponds to a matching notch 128 in the connecting layer 130, as in the embodiments shown here. This allows an arrangement of the cavity 118 on an inner side of the midsole, whereby the electronic component is protected from dirt and water. An access to the component may then be provided from the inside of the shoe, possibly after removing the insole. In some embodiments, the electronic component may also be inserted from the outside of the shoe, but such an arrangement may not be beneficial under certain conditions, such as where the cavity may become soiled, etc. Furthermore, the outsole may comprise a recess 180 that gives an optical indication of the potential presence of an electronic component. In some embodiments, the base body 110 additionally has a corresponding recess 119, in which the recess 180 is arranged in the finished sole 100.

Such an electronic component may, for example, be a chip, a sensor, e.g. an acceleration sensor or a gyroscope or a GPS receiver that records acceleration data or position-related data, etc., e.g. during jogging or running, and stores and transmits them. Particularly in some embodiments, the cavity 118 is, as already mentioned, arranged such that an access to the electronic component is possible, such as from the inside of the shoe, e.g. in order to exchange the component with another component having different functionality, or to charge a power supply of such an electronic component or to replace it with a new power source, e.g. a new battery.

In some embodiments, the material of the base body 110 has a greater deformation stiffness than the material of the deformation elements 120 and/or the material of the connecting layer 130, as already mentioned. For one thing, the base body 110 thereby provides the sole 100 with the necessary base stability that is needed for injury-free running. On the other hand, the deformation behavior of the deformation elements 120 may, as already described above, be further influenced by the shape and size of the notches 115 in which the deformation elements 120 are arranged. This in turn influences the behavior of the sole 100 and in particular the degree to which the first outsole elements 160 penetrate into the material of the deformation elements 120 when treading down. The following materials may be suitable for the manufacture of such an inventive midsole, in particular of the base body 110 and/or the deformation elements 120 and/or the connecting layer 130: polyurethane, ethylene-vinyl-acetate, thermoplastic urethane or a particle foam, in particular from expanded thermoplastic urethane or expanded polypropylene. In some embodiments, the entire midsole is provided as a single integral piece, for example by multicomponent injunction molding. This significantly facilitates further processing of the complete sole or the finished shoe and furthermore increases the durability. At this, for example through an appropriate variation of the density and/or the material composition and/or the manufacturing parameters, the deformation stiffness and other material- and sole properties like color, density, etc., may be further influenced individually in individual parts of the midsole, i.e. for the base body 110 and/or the deformation elements 120 and/or the connecting layer 130.

For example, a material, e.g. polyurethane, with a greater density can initially be cast or injected into a mold with protrusions, hereby fabricating the base body 110 with the notches 115. In a second mold, the notches 115 may then be grouted with a softer material, for example a softer polyurethane, such that the deformation elements 120 and potentially the connecting layer 130 are integrally formed. Depending on the manufacturing process and the manufacturing parameters, the entire midsole may be manufactured as a single integral piece. Or the base body 110 and/or the deformation elements 120 and/or the connecting layer 130 are manufactured separately and are subsequently connected to each other, for example glued or melted together, or the like.

In some embodiments of an inventive sole 100, a single deformation element 120 is associated with each first outsole element 160. Hereby, an individual control of the behavior of each and every first outsole element 160 when treading on the ground is possible. In other embodiments, multiple first outsole elements 160 may be associated with a common deformation element 120. This potentially simplifies the manufacturing process, but may also decrease the possibility to individually influence the behavior of the first outsole elements 160. Furthermore, in some embodiments, there are no first outsole elements 160 and/or deformation elements 120 in the region of the arch of the foot, as already mentioned, so as to not to impair the stability of the sole 100 in the region of the arch of the foot. In other embodiments, first outsole elements 160 and/or deformation elements 120 may be present in the region of the arch of the foot, such as the embodiments 400 and 500 shown in FIGS. 4 and 5, wherein first outsole elements 460 and 560, respectively, are present in the region of the arch of the foot.

In order to further improve the functionality of the inventive sole 100, the first outsole elements 160 may each have an associated flexible region 165 of the outsole that facilitates movement of the first outsole elements 160 relative to the first outsole region 150 and thereby increases the adaptivity of the sole 100 to varying ground conditions. In certain embodiments, one such flexible region 165 surrounds each of the first outsole elements 160. In other embodiments, however, only some of the first outsole elements 160 may be surrounded by such a flexible region 165, and/or multiple first outsole elements 160 may be surrounded by a common flexible region 165. In yet other embodiments, the flexible regions 165 are arranged only at one or more sides of the first outsole elements 160 without surrounding the first outsole elements 160, or the like. Herein, in some embodiments, the outsole material comprises a lower thickness in the flexible regions 165 than in the first outsole region 150. For example, the first outsole region 150 and the flexible regions 165 may be made as a single integral piece from the same material and only differ by their thickness. This increases the durability and resilience of the outsole and simplifies its manufacture.

The outsole may further comprise one or multiple second outsole regions 170 that comprise no first outsole elements 160. Such second outsole regions 170 may, for example, be located in the forefoot region and/or the rear heel region as shown here. In further embodiments, however, the second outsole regions 170 may also be located at the rim of the sole. Such second outsole regions 170 may, for example, comprise second, downward protruding profile elements 175 which are not associated with any deformation elements 120 and which may provide further profiling of the sole 100, for example. At that, the first outsole region 150 and the second outsole region(s) 170 may constitute separate parts of the outsole or they may form a single integral piece, as shown here. Herein, the outsole regions 150, 170 are optionally connected by flexible regions 165 in which the material of the outsole has a lower thickness than in the first and/or second outsole regions 150, 170, for example.

An outsole of an inventive sole 100 may be manufactured from any suitable material including but not limited to rubber, thermoplastic polyurethane, and/or a particle foam, particularly from eTPU or ePP. These materials may be desirable because they are easily processed and at the same time provide a sufficient stability, durability and abrasion resistance.

It shall be mentioned here that an inventive sole 100 may also comprise further elements in addition to the elements shown above, for example elements serving for decoration or further second profiling elements 190. In some cases, the second profiling elements 190 are approximately rectangular and extend to an outer rim of a lower surface of the sole 100. It is in particular pointed to the possibility that the sole 100 further comprises one or multiple reinforcing elements (not shown) in the central, lateral and/or medial midfoot region, which provide an increased stability of the sole in the midfoot region in order to support the wearer's foot during running, to balance an overpronation or supination of the foot, for example. In certain embodiments, a torsion support may be included in the central midfoot region.

Figure 2A:
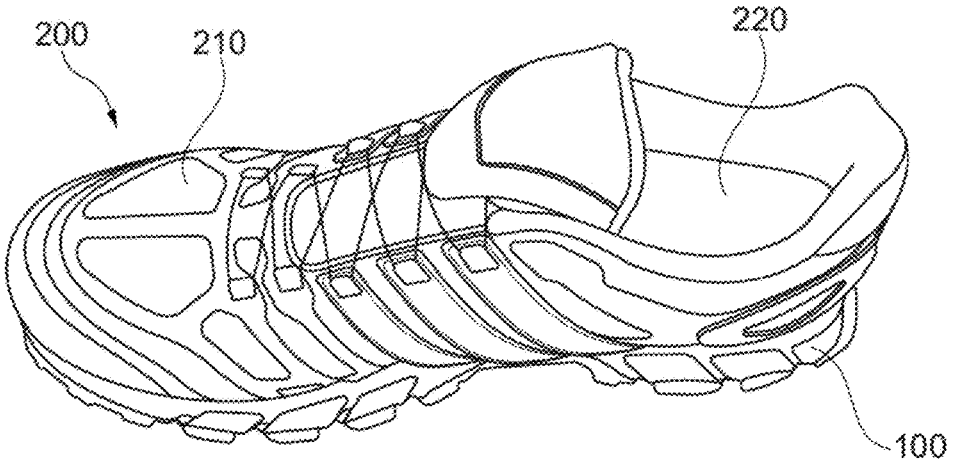
FIGS. 2*a-b* are perspective views of a sports shoe with a sole, according to certain embodiments of the present invention.
Figure 2B:
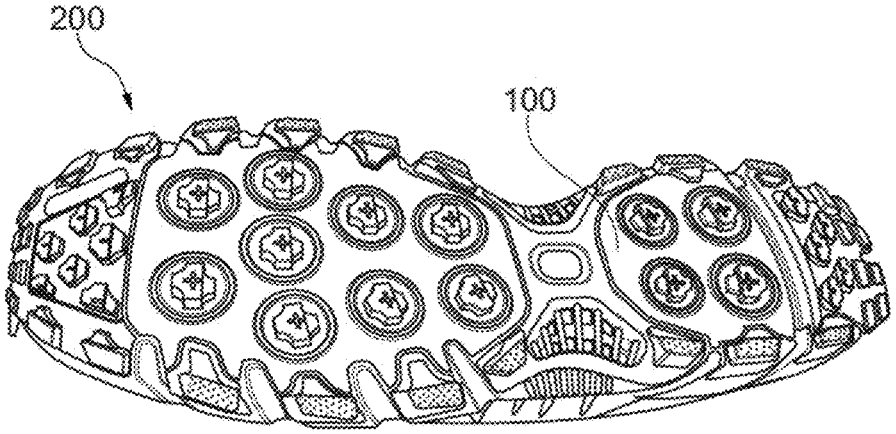

FIGS. 2*a-b* show embodiments of a shoe 200 with an inventive sole 100 as described above, i.e. the sole constructions of FIGS. 1*a-i* and FIGS. 2*a-b* are matching. The shoe 200 further comprises a shoe upper 210 and an insole 220. It shall again be pointed to the fact that for the construction of such a shoe 200, different features described herein with relation to inventive soles may be combined or individual features may be left out if they are of no relevance for the respective intended use of the shoe 200.

Figure 3A:
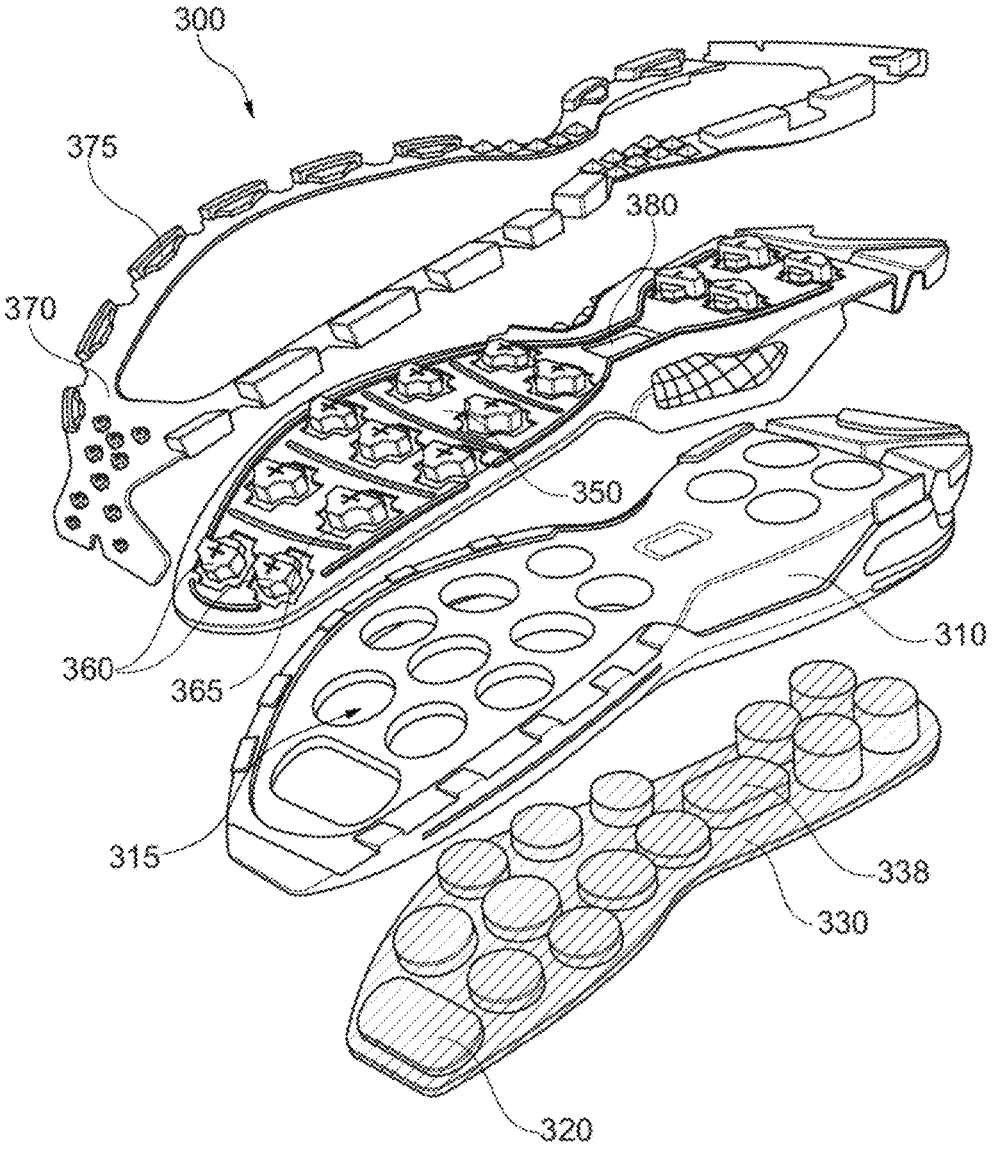
FIGS. 3*a-c* are perspective and side views of a sole, according to certain embodiments of the present invention.
Figure 3B:
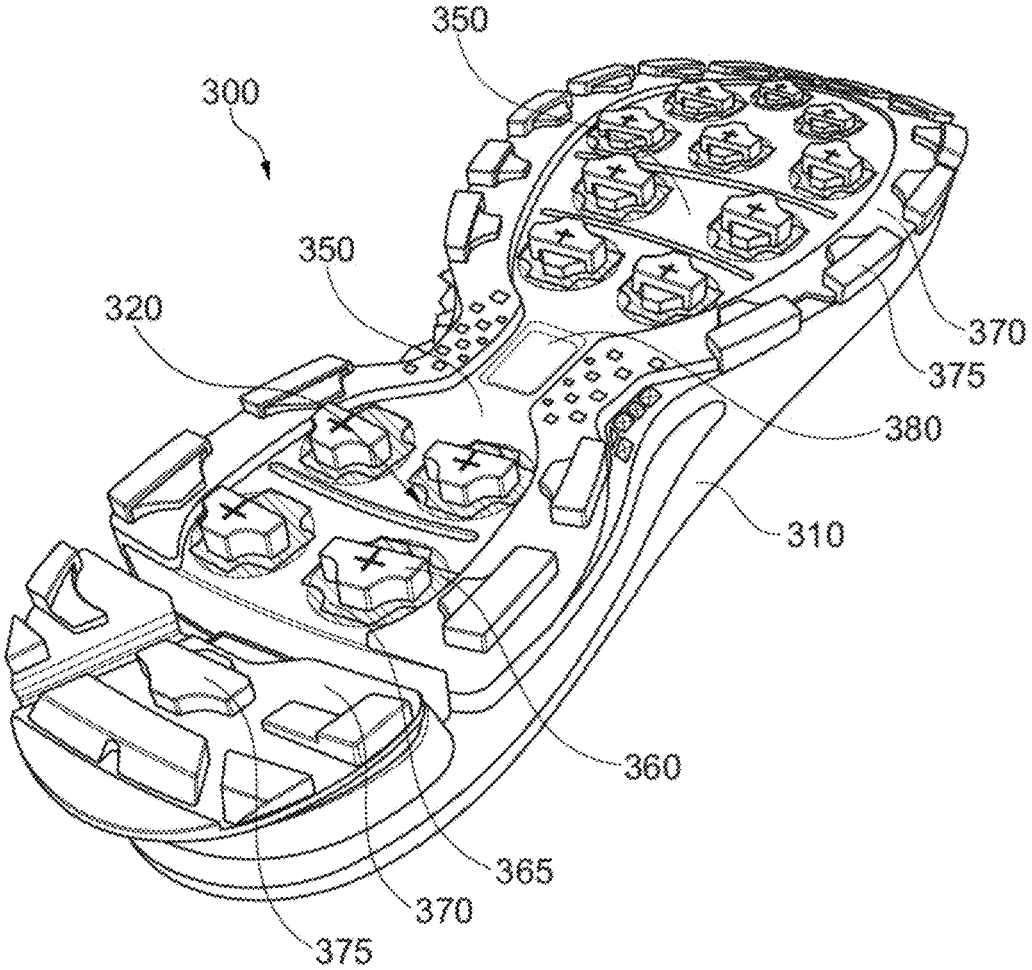
Figure 3C:
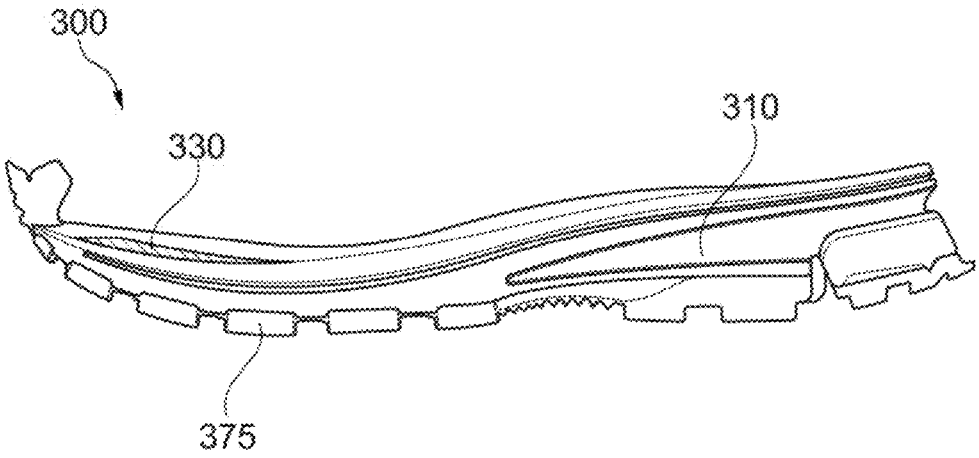

FIGS. 3*a-c* show certain embodiments of an inventive sole 300, which comprises a midsole with a base body 310 and a plurality of deformation elements 320, as well as an outsole with a first outsole region 350 and a plurality of downward protruding first outsole elements 360. The embodiments of FIGS. 3*a-c* differs here from the embodiments of FIGS. 1*a-i* and 2*a-b* in particular by the number of the deformation elements 320. On the other side, also in these embodiments, the deformation elements 320 are connected to one another by a connecting layer 330 as described above and formed as a single integral piece with it. Herein, the connecting layer 330 is arranged on the side of the deformation elements 320 facing the foot such that, if the deformation elements 320 and the base body 310 are assembled, the connecting layer 330 is arranged on the side of the base body 310 facing the foot. Thus, the connecting layer 330 can act as, e.g., a cushioning layer to partially absorb and/or attenuate the forces occurring during walking or running. In the assembled state of the sole 300, the deformation elements 320 are herein further arranged in notches 315 in the base body 310 of the midsole, wherein the deformation elements 320 completely fill up the notches 315 in the embodiments shown here. Here also, no deformation elements 320 and/or first outsole elements 360 are located in the region of the arch of the foot.

However, as already discussed further above in connection with FIGS. 1*a-i*, a recess 380 is located in this region which indicates the potential presence of an electronic component. Such an electronic component can, for example, be accommodated in a cavity 338 in the midsole, and may be arranged on the inner side of the midsole and may be accessible from the inner part of the shoe.

In some embodiments, the outsole further comprises a second outsole region 370 in which no first outsole elements 360 are located. The second outsole region 370 extends, in the embodiments of the sole 300 shown here, throughout the forefoot and heel region as well as along the rim of the sole and comprises a plurality of profile elements 375 that serve the profiling of the sole 300, among other things.

Also here, to each first outsole element 360, there is associated a flexible region 365 of the outsole which facilitates movements of the first outsole elements 360 relative to the first outsole region 350. Herein, the flexible regions 365 surround the first outsole elements 360, and these flexible regions 365 may have a lower thickness of the outsole material than the first outsole region 350. Furthermore, at least for a subset of the first outsole elements 360, exactly one deformation element 320 is associated with each first outsole element 360 of the subset. Worth mentioning is, however, that the two first outsole elements 360 arranged at the tip of the foot are associated with a common deformation element 320 in the present embodiments, which can serve to simplify the manufacture of such a sole 300, for example.

For example, all adjacent (i.e. located approximately on the same level relative to a direction from the tip of the foot to the heel) deformation elements could also be provided as a single integral piece. In the embodiments shown in FIG. 3*a*, this would lead to 5 "rows" in the forefoot region and 2 "rows" in the hindfoot region, instead of 14 individual deformation elements.

In the embodiment 300 shown here, the first outsole region 350 and the first outsole elements 360 are furthermore formed at least partially transparent. In the finished sole 300, the deformation elements 320 and the base body 310 are thus at least partially visible from outside, as indicated in FIG. 3*b*. Different colorings of the base body 310 and the deformation elements 320 visualize the functionality.

Figure 4:
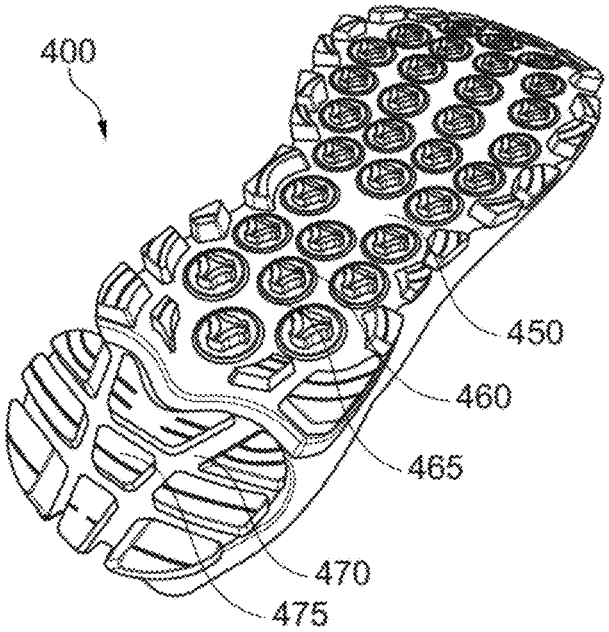
FIGS. 4, 5 are perspective views of shoe soles of a sole, according to certain embodiments of the present invention.
Figure 5:
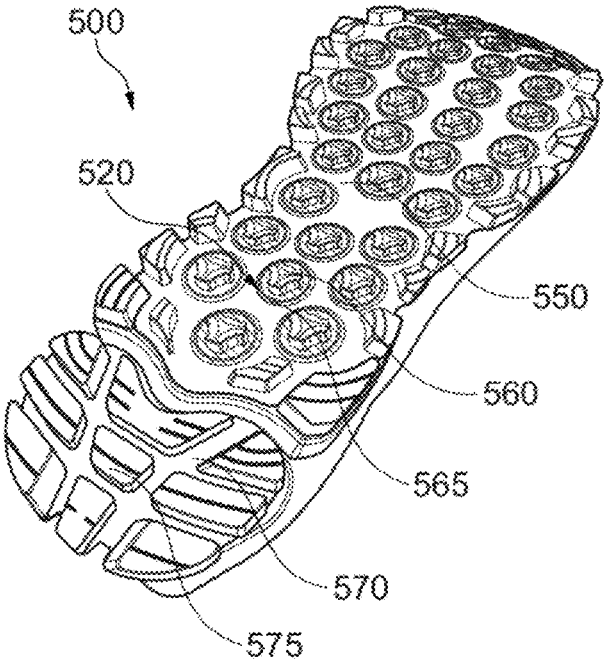

FIGS. 4 and 5 show further embodiments of inventive soles 400, 500.

The sole 400 in particular comprises an outsole made from rubber and formed as a single integral piece. The outsole comprises a first outsole region 450 and a second outsole region 470. The outsole further comprises a plurality of first downward protruding outsole elements 460 which each have an associated flexible region 465, as already described several times. Moreover, the second outsole region 470 comprises a plurality of downward protruding profile elements 475 which serve a further profiling of the sole 400, among other things. Contrary to the embodiments 100 and 300 of inventive soles described above, however, the sole 400 comprises first outsole elements 460 and deformation elements (not shown) also in the region of the arch of the foot. In addition, the first outsole elements 460 are triangular in this instance.

Regarding the inventive sole 500 shown in FIG. 5, essentially the same considerations as for the sole 400 shown in FIG. 4 apply: the outsole comprises a first outsole region 550 and a second outsole region 570. The outsole further comprises a plurality of first downward protruding outsole elements 560, also in the region of the arch of the foot, which each have an associated flexible region 565. Moreover, the second outsole region 570 comprises a plurality of profile elements 575.

However, in certain embodiments, the outsole of the sole 500 is not entirely made from rubber. Rather, the first outsole region 550 comprises thermoplastic polyurethane and the first outsole region 550 and/or the first outsole elements 560 are formed at least partially transparent. This allows, inter alia, for a look into the "inner workings" of the sole 500 from the outside, in particular a look at the deformation elements 520 and the base body, as indicated in FIG. 5. The second outsole region 570 in the toe region (not shown, located before the forefoot region) and the rear heel region, i.e. the region behind the heel bone/calcaneus—the area with which the runner contacts the ground first when running—is, however, also made from rubber in certain embodiments.

FIGS. 6*a-b* and 7*a-b* once again illustrate the working principle and adaptivity of an inventive sole compared to a conventional shoe sole with downward protruding outsole elements.

Figure 6A:
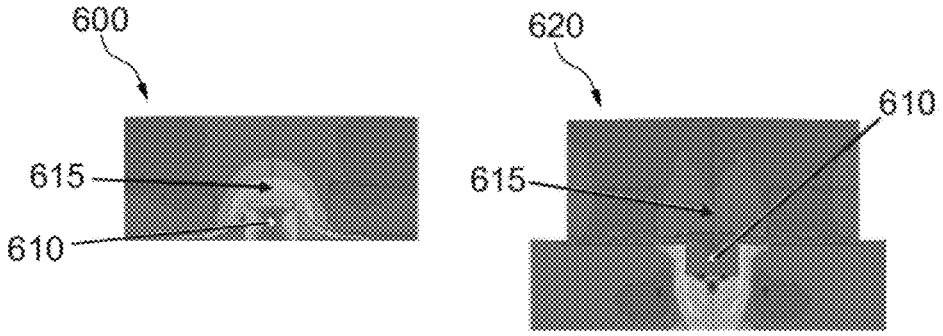
FIGS. 6*a-b* is a comparison of the behavior of a shoe with an inventive sole and an conventional shoe when treading down on hard and soft grounds.
Figure 6B:
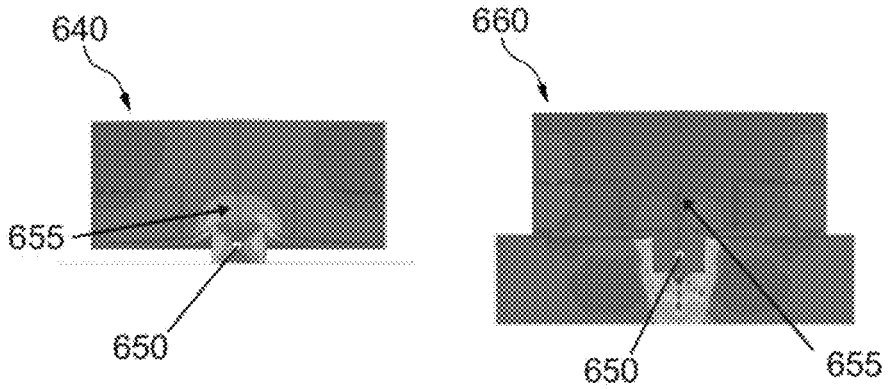

FIG. 6*a* shows the situation when treading down on hard ground (cf. 600) and on soft ground (cf. 620) for a part of an inventive sole, which comprises a first outsole element 610 and a deformation element 615. FIG. 6*b* shows the situation when treading down on hard ground (cf. 640) and on soft ground (cf. 660) for a part of a conventional sole, which also comprises a downward protruding first outsole element 650.

As can be seen from the illustration 600, when treading down on hard ground with an inventive sole, the first outsole element 610 may be pressed into the deformation element 615 to such an extent that the sole can essentially line up flat with the ground. Here, the construction of the inventive midsole out of a base body and a plurality of deformation elements 615 may be achieved: this construction provides deformation elements 615 with sufficient deformation capacities that allow for the above explained behavior of the sole, i.e. the almost complete penetration of the outsole elements 615 into the material of the midsole when treading down on hard ground, while the base body provides a sufficient base stability of the sole. As can be seen from illustration 640, for the conventional sole, however, the deformation capacity of the midsole material in the region 655 adjacent to the outsole element 650 is typically not sufficient to allow the outsole element 650 to penetrate into the midsole to such an extent that the sole can line up flat with the ground.

On the other side, the material and the shape of the deformation elements 615 of the inventive sole, in particular the deformation stiffness of the material, is chosen so that the deformation elements 615 offer a sufficient resistance to the penetration of the first outsole elements 610 when treading down on soft ground, as shown in illustration 620. Thereby, the outsole elements 610 penetrate into their associated deformation elements 615 in this case only marginally, but in any case not completely. The outsole elements 610 in this case thus act as a kind of "cleats" or "knobs" and provide the shoe with additional grip, similar to the behavior of the conventional shoe when treading down on soft ground, cf. illustration 660.

It is apparent to a skilled person that it decisively depends on the material and the shape of the deformation elements 615 whether a given ground constitutes a "soft" or a "hard" ground for the inventive shoe and whether the sole accordingly behaves (essentially) according to illustration 600 or to illustration 620 on such a given ground. It is furthermore to be noted that the illustrations 600, 620, 640 and 660 are idealized representations that have the purpose to elucidate to a skilled person the basic working principle of an inventive sole compared to a conventional sole. In reality, the situation can also lie between the cases shown here.

Hence, through an appropriate choice of the material and the shape of the deformation elements 615, the behavior of the shoe may be tailored to a multitude of factors. In such a way, the shoe can, for example, be adapted optimally to the weight of a runner, his characteristic running style and/or a class of predominantly encountered ground conditions. For example, a shoe may be specifically manufactured for street-runs (i.e. mainly for hard grounds), for forest and street-runs (i.e. a plurality of different grounds) or for use on a lawn pitch or golf course (i.e. mainly soft grounds). It may be desirable here that the behavior of the first outsole elements 615 may be controlled and influenced individually and essentially independently.

Figure 7A:
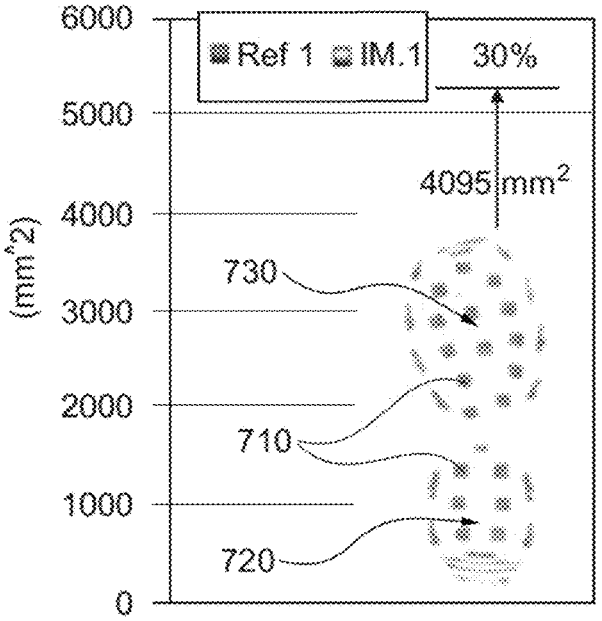
FIGS. 7*a-b* is a comparison of the contact area of a shoe with an inventive sole and a conventional shoe.
Figure 7B:
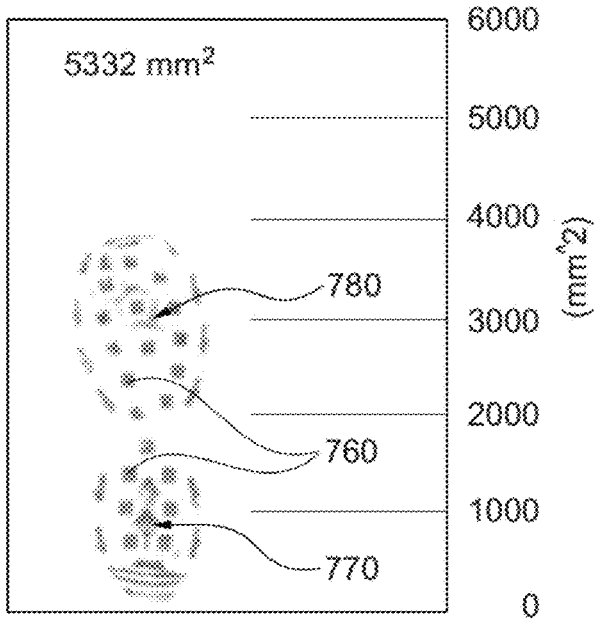

FIGS. 7*a-b* show the comparison of two measurements of the contact area of two soles when treading down on a given ground. The measurement result in FIG. 7*a* shows the situation for a conventional shoe and the measurement result in FIG. 7*b* for a shoe with an inventive sole. Here, both shoes have the same arrangement of downward protruding outsole elements 710 and 760 on the outsole; in the case of the inventive sole these are, however, associated to deformation elements of the midsole, as already explained several times. For the case of the conventional sole, by contrast, such deformation elements are missing.

As can clearly be gathered from FIG. 7*b*, individual first outsole elements 760 of the inventive sole are pressed into the sole to such an extent that the outsole enters into contact with the ground in the regions 770 and 780 of the first outsole region. For the conventional sole such a contact does not occur, cf. the corresponding regions 720 and 730 in FIG. 7*a*. This leads to a contact area of the inventive sole that is increased by approximately 30% compared to the conventional sole and therefore to improved grip on the ground. It is further mentioned at this point that for the measurements shown here, a precisely planar measurement surface was used. As a result, the additional contact area of the inventive sole in the regions 770 and 780 may not seem significant. It is to be taken into consideration, however, that under realistic conditions and on uneven ground, the beneficial effects described herein can have a much more significant effect.

Figure 8A:
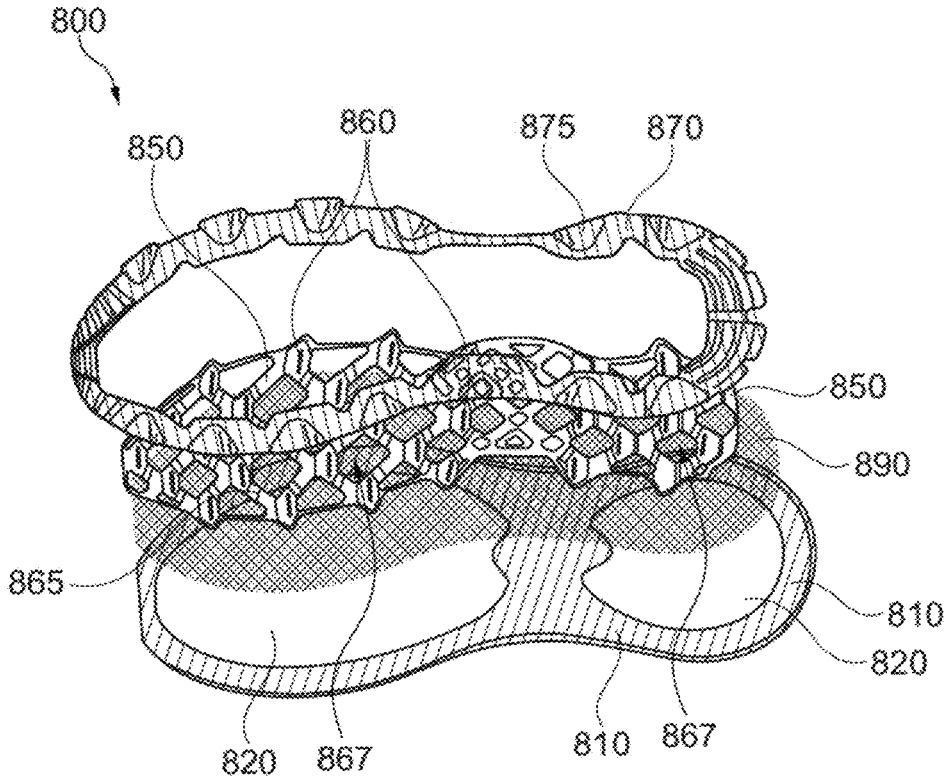
FIGS. 8*a-c* are perspective and side views of a sole with a grid-shaped first outsole region, according to certain embodiments of the present invention.
Figure 8B:
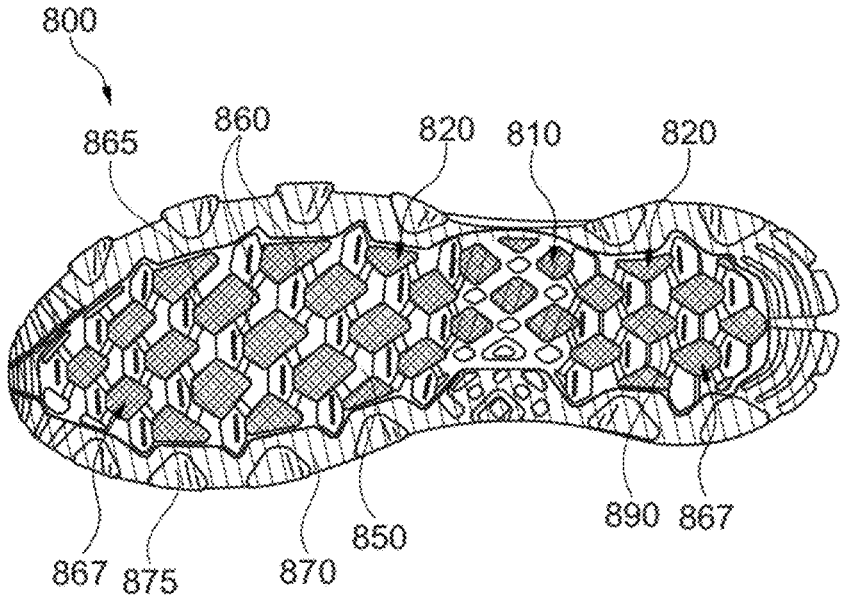
Figure 8C:
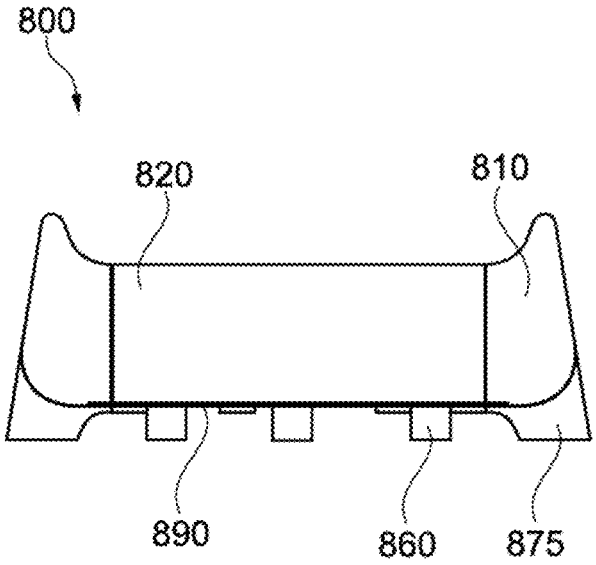

FIGS. 8*a-c* show a further embodiment 800 of an inventive sole. The sole 800 comprises a midsole comprising a base body 810 and two deformation elements 820. In some embodiments, the base body 810 comprises ethylene-vinyl-acetate (EVA) of a greater stiffness, whereas the two deformation elements 820 comprise EVA of a lower stiffness. Here, the base body 810 and the deformation elements 820 may be manufactured jointly, in particular integrally in one piece, for example by two-component injection molding. In other embodiments, the base body 810 and the deformation elements 820 are manufactured through a die cutting process and then joined together. Alternatively, the deformation elements 820 comprise a particle foam, in particular a particle foam from expanded thermoplastic urethane or expanded polypropylene. The harder base body 810 is in this case may be arranged around the rim of the sole 800 and in the midfoot region and provides the sole 800 with the required stability.

The sole 800 further has an outsole comprising a first outsole region 850, as well as a plurality of first downward protruding outsole elements 860. These may be, as is shown here, provided in a single integral piece with the first outsole region 850. The first outsole region 850 has a grid shape in the present case. A honeycomb structure or a polygonal, i.e. an n-sided structure would also be conceivable. Herein, the first outsole elements 860 are arranged in an assembled state of the sole 800 (cf. FIGS. 8*b* and 8*c*) in relation to the deformation elements 820 in such a way that a pressure load on a first outsole element 860 leads to a deformation of its associated deformation element 820 of the midsole. In order to support this process, at least one flexible region 865 of the outsole is associated with each of the first outsole elements 860, said flexible region may have a lower thickness of the outsole material than the first outsole region 850.

In the embodiments shown here, the first outsole region 850 has, as already mentioned, a grid-like shape, so that the first outsole elements 860 may move independently of one another to a large degree. This allows a high adaptivity of the sole 800 to various grounds and also the compensation of smaller unevenness, as already discussed several times. Through the grid-like structure, apertures or notches 867 result in the outsole, through which the midsole is at least partially visible/accessible from outside in the embodiment 800 shown here. In other embodiments, a perforated material or a material, for example rubber, which has a lower thickness compared with the first outsole region 850, may be used in these regions.

In addition, in some embodiments, there may be no first outsole elements 860 or deformation elements 820, respectively, in the region of the arch of the foot.

The outsole furthermore comprises a second outsole region 870 that does not comprise any first outsole elements 860 and is arranged around the rim of the sole 800 here. Other arrangements are, however, also conceivable, for example in the toe region and/or in the (rear) heel region. However, the second outsole region comprises a plurality of profile elements 875 which can, for example, serve a further profiling of the sole 800.

Furthermore, between the outsole and the midsole, a protective element 890 may be arranged. In the present case, this is a grid-like or fabric-like protective element. In other embodiments, a foil-like protective element, for example a foil comprising thermoplastic urethane, may be included. The protective element mainly serves to protect the midsole from external influences like moisture or abrasion. Since in this embodiment 800, due to the grid-shape form of the first outsole region 850, as already mentioned, apertures 867 result in the outsole, so that the midsole is at least partially accessible from outside, such a protection may be particularly desirable here. In order not to influence or not substantially influence the functionality or the adaptivity of the sole according to the invention, the protective element further has notches in the regions of several, and in some embodiments of all, first outsole elements.

Figure 9:
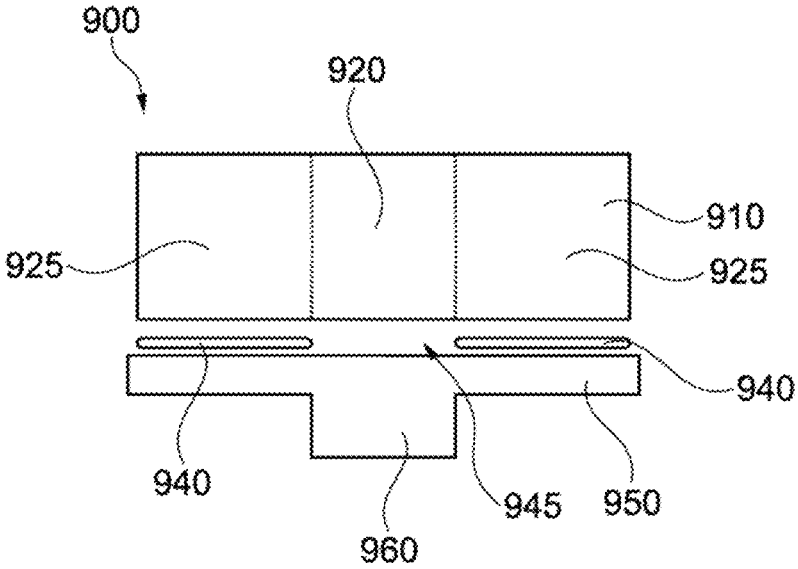
FIG. 9 is a side view of a sole in which the deformation elements are formed out of the base body, according to certain embodiments of the present invention.

FIG. 9 finally shows a cross-section through a further embodiment 900 of the present invention. Shown is a cross-section through a sole 900 which comprises a midsole. The latter, in turn, comprises a base body 910 and a plurality of deformation elements 920 (in the cross-section shown here, only one deformation element 920, one first outsole element 960, etc., are visible). In the embodiment 900 shown here, the midsole consists of one single material, for example a particle foam from expanded thermoplastic urethane or expanded polypropylene. The plurality of deformation elements 920 are herein formed out of the base body 910 as a result of the fact that on the side of the base body 910 that faces away from the foot (in FIG. 9, this is the bottom side of the base body 910), a reinforcement layer 940 is arranged, which has a respective opening 945 in each of the regions 920 of the base body 910 which act as deformation elements 920. This allows the first outsole elements 960, which may be formed in one single integral piece with a first outsole region 950, to at least partially penetrate into the material of the base body 910 in the regions 920 under a pressure load (see above), which thus act as deformation elements. The regions 925 adjacent to the reinforcement layer 940 of the base body 910, in contrast, receive the stability required for the midsole of a shoe, in particular a sports shoe, from the reinforcement layer 940. For this, the regions 925 are, for example, firmly bonded to the reinforcement layer 940, maybe via an adhesive bonding, or the like. With the embodiment 900 of an inventive sole described here, the number of required individual parts for the manufacture of such a sole 900, and thus the manufacturing effort, may be further reduced.

In some embodiments, the reinforcement layer 940 comprises a plate-like element and/or a stretch-resistant foil-like element or is formed by such an element. "Stretch-resistant" is understood by a person of ordinary skill in the relevant art to mean a material which can offer a not insignificant resistance to stretching forces. Hence, for example, a material which under stretching forces typically occurring when wearing a shoe with a sole 900 does not stretch by more than 1%, by more than 5%, by more than 10% or by more than 20% in the direction of the stretching forces.

In addition to the embodiment 900 described here, in other embodiments, such a reinforcement layer is combined with other inventive embodiments described herein, in order to, for example, allow an even more accurate control of the sole properties.

In the following, further examples are described to facilitate the understanding of the invention:

1. Sole (100; 300; 400; 500; 800; 900) for a shoe, in particular a sports shoe, comprising:
   a. a midsole, comprising a base body (110; 310; 810; 910) and a plurality of deformation elements (120; 320; 520; 615; 820; 920); and
   b. an outsole, comprising a first outsole region (150; 350; 450; 550; 850; 950) and a plurality of first outsole elements (160; 360; 460; 560; 610; 760; 860; 960);
   c. wherein a pressure load on a first outsole element (160; 360; 460; 560; 610; 760; 860; 960) leads to a deformation of at least one of the deformation elements (120; 320; 520; 615; 820; 920) which are associated with the first outsole element (160; 360; 460; 560; 610; 760; 860; 960).
2. Sole (100; 300; 400; 500; 800; 900) according to example 1, wherein the first outsole elements (160; 360; 460; 560; 860; 960) are formed integrally with the first outsole region (150; 350; 450; 550; 850; 950).
3. Sole (100; 300; 400; 500; 800; 900) according to one of the preceding examples, wherein the first outsole elements (160; 360; 460; 560; 610; 760; 860; 960) are arranged in a downward protruding manner.
4. Sole (100; 300; 400; 500; 800) according to one of the preceding examples, wherein the base body (110; 310; 810) comprises a plurality of notches (115; 315) in which the deformation elements (120; 320; 520; 820) are arranged.
5. Sole (100; 300; 400; 500; 800) according to example 4, wherein in every notch (115; 315) there is arranged one deformation element (120; 320; 520; 820).
6. Sole (100; 400; 500) according to one of the preceding examples, wherein the deformation elements (120) are essentially cylindrically formed.
7. Sole (100; 300; 400; 500) according to one of the preceding examples, wherein the midsole further comprises a connecting layer (130; 330) by which multiple deformation elements (120; 320) are connected to each other.
8. Sole (100; 300; 400; 500) according to example 7, wherein the deformation elements (120; 320) and the connecting layer (130; 330) are provided as a single integral piece.
9. Sole (100; 300; 400; 500) according to one of examples 7-8, wherein the connecting layer (130; 330), in the assembled state of the sole (100; 300), is arranged on the side of the base body (110; 310) that is facing the foot.
10. Sole (100; 300; 400; 500; 800) according to one of the preceding examples, wherein the material of the base body (110; 310; 810) has a greater stiffness than the material of the deformation elements (120; 320; 520; 820).
11. Sole (100; 300; 400; 500; 800; 900) according to one of the preceding examples, wherein the midsole is provided as a single integral piece.
12. Sole (100; 300; 400; 500; 800; 900) according to one of the preceding examples, wherein the midsole further comprises at least one cushioning insert in the forefoot region and/or the heel region.
13. Sole (100; 300; 400; 500; 900) according to one of the preceding examples, wherein at least for a subset of the first outsole elements (160; 360; 560; 960) each first outsole element (160; 360; 560; 960) of the subset has exactly one associated deformation element (120; 320; 520; 920).
14. Sole (100; 400; 500; 900) according to one of the preceding examples, wherein all of the first outsole elements (160; 460; 560; 960) each have exactly one associated deformation element (120; 520; 920).
15. Sole (100; 300; 400; 500; 800; 900) according to one of the preceding examples, wherein the first outsole elements (160; 360; 460; 560; 860; 960) each have an associated flexible region (165 365; 465; 565; 865) of the outsole, which facilitates movement of the first outsole elements (160; 360; 460; 560; 860; 960) relative to the first outsole region (150; 350; 450; 550; 850; 950).
16. Sole (100; 300; 400; 500; 900) according to example 15, wherein the flexible regions (165; 365; 465; 565) surround the first outsole elements (160; 360; 460; 560; 960).
17. Sole (100; 300; 400; 500; 800; 900) according to example 15 or 16, wherein the flexible regions (165; 365; 465; 565; 865) have a lower thickness of the outsole material than the first outsole region (150; 350; 450; 550; 850; 950).
18. Sole (800; 900) according to one of the preceding examples, wherein the first outsole region (850) has a grid-shaped form.
19. Sole (100; 300; 400; 500; 800; 900) according to one of the preceding examples, wherein the outsole further comprises a second outsole region (170; 370; 470; 570; 870) which comprises no first outsole elements (160; 360; 460; 560; 860; 960).
20. Sole (100; 300; 400; 500; 900) according to example 19, wherein the second outsole region (170; 370; 470; 570) is arranged in the toe region, the midfoot region and/or the heel region.
21. Sole (300; 800; 900) according to example 19 or 20, wherein the second outsole region (370; 870) is arranged at the rim of the sole.
22. Sole (100; 300; 400; 500; 800; 900) according to one of the examples 19-21, wherein the second outsole region (170; 370; 470; 570; 870) comprises profile elements (175; 375; 475; 575; 875).
23. Sole (800) according to one of the preceding examples, wherein a protective element (890) is arranged between the outsole and the midsole.
24. Sole (800) according to example 23, wherein the protective element has notches in the region of the first outsole elements.
25. Sole (100; 300; 800; 900) according to one of the preceding examples, wherein no first outsole elements (160; 360; 860; 960) and/or no deformation elements (120; 320; 820; 920) are located in the region of the arch of the foot.
26. Sole (300; 500; 900) according to one of the preceding examples, wherein the first outsole region (350; 550; 950) and/or the first outsole elements (360; 560; 960) are formed at least partially transparent.
27. Sole (100; 300; 400; 500; 800; 900) according to one of the preceding examples, wherein the sole further comprises at least one reinforcing element in the central, lateral and/or medial midfoot region.

28. Sole (100; 300; 400; 500; 800; 900) according to one of the preceding examples, wherein the sole further comprise a cavity (118; 338) for receiving an electronic component.

29. Sole (900) according to one of the examples 1-3 or 11-28, wherein the plurality of deformation elements (920) are formed out of the base body (910) as a result of the fact that a reinforcement layer (940) is arranged on the side of the base body that faces away from the foot, which has a respective opening (945) in each of the regions (920) of the base body (910) acting as deformation elements.

30. Sole (900) according to example 29, wherein the reinforcement layer comprises a plate-like and/or stretch-resistant foil-like element.

31. Shoe (200), in particular a sports shoe, comprising a sole (100; 300; 400; 500; 800; 900) according to one of the preceding examples.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sole for a shoe comprising:

a midsole comprising a base body and a connecting layer; and an outsole comprising a first outsole region and a plurality of first outsole elements;

a second outsole region comprising no first outsole elements; and a cavity located in an arch region of the sole for receiving an electronic component such that an interior of the cavity is accessible through an inside of the shoe; and a reinforcement layer located between the midsole and the outsole, wherein:

the base body comprises a cavity that corresponds to the cavity of the outsole;

the connecting layer comprises a notch that corresponds to the cavity of the outsole;

the connecting layer is a single integral piece comprising a first group of deformation elements forward of the arch region and a second group of deformation elements rearward of the arch region of the sole;

the reinforcement layer comprises a through hole corresponding to at least one of the first group of deformation elements and to at least one of the second group of deformation elements;

a pressure load on a first outsole element of the plurality of first outsole elements leads to a deformation of at least one of the deformation elements which are associated with the first outsole element of the plurality of first outsole elements;

the outsole forms an entirety of a lower surface of the sole;

the outsole comprises at least two separate components such that the lower surface of the sole is discontinuous;

the second outsole region comprises:

a first plurality of profile elements that are approximately rectangular and extend to an outer rim of a lower surface of the sole;

a second plurality of profile elements that each have a cross shape and are located forward of the arch region;

a third plurality of profile elements that each have a cross shape and are located rearward of the arch region; and all of the profile elements of the second outsole region are not associated with any of the deformation elements.

2. The sole according to claim 1, wherein the second outsole region is arranged in at least one of a toe region, a midfoot region, and a heel region.

3. The sole according to claim 1, wherein all of the second plurality of profile elements are located inside a trapezoidal area in a forefoot region of the sole wherein the trapezoidal area is located forward of a forwardmost deformation element and all of the third plurality of profile elements are located rearward of a rearmost deformation element.

4. The sole according to claim 1, wherein each of the plurality of first outsole elements comprises a cross shape.

5. The sole according to claim 1, wherein:

at least one of the cavity of the outsole and the cavity of the base body is accessible through an inside of the shoe after an insole is removed from the shoe.

6. The sole according to claim 4, wherein each of the plurality of first outsole elements is larger than each of the profile elements of the second and third pluralities.

7. The sole according to claim 1, wherein each of the first plurality of profile elements comprise long edges and short edges such that one of the long edges is approximately aligned with the outer rim of the lower surface of the sole.

8. The sole according to claim 1, wherein at least one of the plurality of first outsole elements is separate from the outsole, and wherein at least one of the profile elements of the second outsole region is separate from the outsole.

* * * * *